US005398739A

United States Patent [19]

Everts et al.

[11] Patent Number: 5,398,739

[45] Date of Patent: Mar. 21, 1995

[54] ROTARY CUTTING HEAD ASSEMBLY

[75] Inventors: Robert G. Everts, Chandler, Ariz.; Kouichi Miyamoto, Tokyo, Japan

[73] Assignee: Ryobi America Corporation, Easley, S.C.

[21] Appl. No.: 61,156

[22] Filed: May 12, 1993

[51] Int. Cl.[6] ..... B27C 1/10; B27G 13/04

[52] U.S. Cl. ..... 144/225; 83/674; 83/698.11; 144/117 R; 144/218; 144/241; 407/113; 30/346.1; 30/351

[58] Field of Search ..... 407/77, 113; 83/674, 83/698, 699, 700; 144/114 R, 117 R, 117 C, 225, 226, 227, 230, 231, 241; 30/346.1, 351

[56] References Cited

U.S. PATENT DOCUMENTS

| | | | |
|---|---|---|---|
| 1,294,638 | 2/1919 | Draper | 144/225 |
| 1,397,014 | 11/1921 | Oliver | 144/225 |
| 2,283,721 | 5/1942 | Brockhurst . | |
| 2,652,869 | 9/1953 | Goodman et al. | 144/241 |
| 2,676,406 | 4/1954 | Hoke | 30/351 |
| 2,735,174 | 2/1956 | Gyllenberg | 30/346.1 |
| 2,813,558 | 11/1957 | Pedersen . | |
| 2,917,091 | 12/1959 | Smith et al. . | |
| 3,593,416 | 7/1971 | Edson . | |
| 3,600,816 | 8/1971 | Watanabe . | |
| 3,626,591 | 12/1971 | Roby . | |
| 3,673,907 | 7/1972 | Watanabe . | |
| 3,732,611 | 5/1973 | Watanabe . | |
| 3,791,001 | 2/1974 | Bennett . | |
| 3,894,340 | 7/1975 | Ellis, Jr. . | |
| 4,066,111 | 1/1978 | Klebe, Jr. . | |
| 4,347,882 | 9/1982 | Bachmann | 144/225 |
| 4,382,729 | 5/1983 | Bachmann | 144/117 C |
| 4,610,285 | 9/1986 | Derivaz . | |
| 4,749,014 | 6/1988 | Schlund | 144/225 |
| 4,977,937 | 12/1990 | Hessenthaler | 144/117 R |

*Primary Examiner*—W. Donald Bray
*Attorney, Agent, or Firm*—Brooks & Kushman

[57] ABSTRACT

The present invention includes a rotatable cutting head assembly (12), such as for a planer or a jointer, which planes a work surface on a workpiece (22). The cutting head assembly (12) comprises a rotatable elongate support block (30), a pair of blades (32), and a pair of elongate retainers (34). Each blade (32) has a straight elongate cutting edge (50,51) which extends parallel to and is spaced radially from the longitudinal axis (36) of the support block (30). Each retainer (34) is attachable to the support block (30) to clamp a respective blade (32) therebetween. Retainers (34), blades (32) and support block (30) have cooperating alignment ribs (64) and elongate slots (52). The slots (52) extend parallel to the longitudinal axis of the support block. The cooperating alignment ribs and elongate slots maintain cutting edges (50,51) at equal radial distances from the longitudinal axis (36) while permitting the blades (32) to be longitudinally adjustable relative to the support block (30) to enable a user to offset any longitudinally aligned nicks formed on the cutting edges (50,51) during planing so that the cutting edges (50,51) create a smooth planar surface which is free of ridges on workpiece (22).

16 Claims, 1 Drawing Sheet

ROTARY CUTTING HEAD ASSEMBLY

FIELD OF INVENTION

The present invention relates to rotary cutting head assemblies having elongate blades for planers and jointers.

BACKGROUND OF INVENTION

Planers and jointers are used to smooth or plane non-planar surfaces on workpieces such as wooden planks or boards. These planers and jointers include rotary cutting head assemblies having blades with straight elongate cutting edges. The cutting edges rotate about a longitudinal axis and shave material from the surface of the workpiece which is to be planed. If the cutting edges on the blades are perfectly straight, the cutting edges sweep out a cylindrical surface as the cutting head assemblies rotate. When the cutting edges engage an uneven or non-planar work surface on a workpiece, portions of the work surface are planed or shaved away. This planing operation is continued until the entire work surface is planar.

When a workpiece contains an unusually hard anomaly, such as nail or a knot, the cutting edges on the blades can become nicked or damaged. As the cutting head assembly rotates at high speeds, usually all of the cutting edges on the blades are nicked or damaged in a plane perpendicular to the longitudinal axis of the cutting head assembly in which the anomaly lies. Accordingly, the cutting edges will no longer sweep out a perfect cylindrical surface, but rather, will generate a generally cylindrical surface having annular grooves therein where the cutting edges are nicked. Correspondingly, a complementary ridge will be formed on the work surface being cut by the blades. Therefore, the work surface which is planed will no longer be planar.

The nicked blades will have to be replaced or reworked to provide straight cutting edges in order to properly plane work surfaces. As a result, producing ideally planar surfaces on workpieces can be expensive. Also, considerable time must be taken to disassemble the cutting head assembly, replace the blades, and reassemble the cutting head assembly.

The present invention is intended to overcome these shortcoming of planers and jointers using conventional cutting head assemblies.

SUMMARY OF THE INVENTION

The present invention includes a rotatable cutting head assembly, such as for a planer or a jointer, which planes a work surface on a workpiece. The cutting head assembly comprises a rotatable elongate support block, a pair of blades, and a pair of elongate retainers. The support block is elongate and extends along a longitudinal axis. The pair of blades are circumferentially spaced about and are removably attached to the support block. Each blade has a straight elongate cutting edge which extends parallel to and is spaced radially from the longitudinal axis of the support block. Each retainer is attachable to the support block to clamp and hold a respective blade therebetween.

The retainers, the blades and the support block have cooperating alignment ribs and elongate slots. The slots extend parallel to the longitudinal axis of the support block. The cooperating alignment ribs and elongate slots maintain at least two of the cutting edges at equal radial distances from the longitudinal axis while permitting the blades to be longitudinally adjustable relative to the support block to enable the user to offset any longitudinally aligned nicks formed on the cutting edges during planing so that the cutting edges create a smooth planar surface on a workpiece which is free of ridges.

Preferably, the elongate slots are formed in the blades and the alignment ribs are formed in the retainer. Further, ideally each blade has a pair of longitudinally spaced elongate slots and each retainer has a pair of corresponding longitudinally spaced alignment ribs. The elongate slots may be centrally located between first and second cutting edges on each blade so that the blades may be reversibly mounted to the support block with either of the first or second cutting edges extending laterally and being exposed from the corresponding retainers to plane the workpiece.

It is an object of the present invention to provide a rotary cutting head assembly which has a pair of blades with circumferentially spaced cutting edges which rotate about a longitudinal axis and which are longitudinally adjustably mounted within the cutting head assembly so that longitudinally aligned nicks formed in the cutting edges can be offset from one another by longitudinally moving one of the blades relative to the other so that the cutting edges create a smooth planar surface on a workpiece which is free of ridges.

It is another object to provide a cutting head assembly in which cutting edges on the blades are held in radially fixed positions relative to the longitudinal axis of the cutting head assembly so that the cutting edges do not need to be radially adjusted when they are mounted to a rotatable support block.

It is yet another object to provide an elongate cutting head assembly which has a pair of blades, each blade having a pair of cutting edges, wherein the blades may be longitudinally adjustably mounted within the cutting head assembly and reversibly mountable so that either cutting edge on each blade can be used to cut and plane a workpiece and then the blade may be reversibly mounted so that the other cutting edge of each blade is then used to cut and plane the workpiece.

BRIEF DESCRIPTION OF THE DRAWINGS

These and other features, aspects, and advantages of the present invention will become better understood with regard to the following description, appended claims, and accompanying drawings where:

BEST MODE FOR CARRYING OUT THE INVENTION

Figure 1:
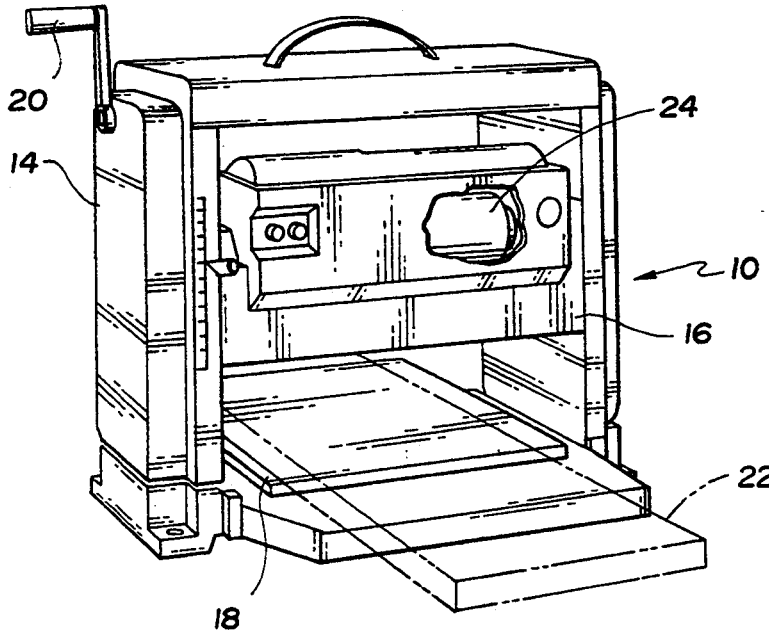
FIG. 1 is a perspective view, partially cutaway, of a planer which utilizes a cutting head assembly made in accordance with the present invention.
Figure 2:
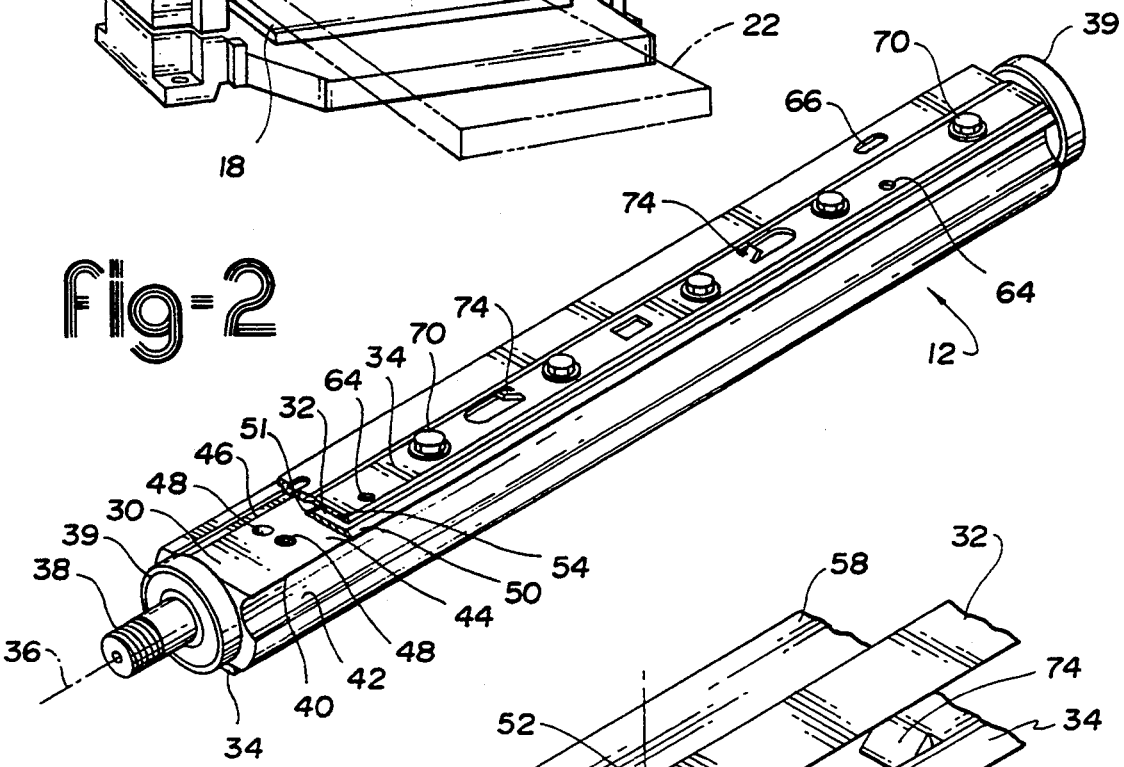
FIG. 2 is a perspective view, partially in cutaway, of the cutting head assembly used in the planar of FIG. 1.

Turning now to FIG. 1, a portable planer 10 is shown which utilizes a cutting head assembly 12, made in accordance with the present invention, which is illustrated in FIG. 2. Planer 10 includes a frame 14 which supports a carrier 16 and a platen 18. A crank 20 utilizes a plurality of gears (not shown) to raise and lower carrier 16 relative to platen 18. A workpiece 22, such as a wooden plank or board, is shown in phantom and resides upon platen 18. Cutting head assembly 12 is rotatably supported within carrier 16 and is rotatably driven by a motor 24 located within carrier 16.

Cutting head assembly 12 is shown in FIG. 2 and is comprised of a support block 30, a pair of circumferentially spaced blades 32, and a pair of circumferentially spaced retainers 34 which clampingly retain blades 32 to support block 30. Only one blade 32 is shown in FIG. 2 with the other blade 32 being hidden and diametrically opposed relative to the first blade 32.

Support block 30 is elongate and extends along a longitudinal axis 36. A pair of shafts 38 extend from either end of support block 30 and are mountable within carrier 16. A pair of bearings 39 are located about respective shafts 38 to permit the rotation of cutting head assembly 12 within carrier 16.

Support block 30 has an elongate main body 40 which is generally of a cylindrical shape. Extending longitudinally along main body 40 are diametrically opposed pairs of undercuts 42 and flat planar portions 44. Undercuts 42 provide relief so that blades 32 may better engage workpiece 22 as work surfaces thereon are planed. Planar portions 44 are adapted to flushly receive planar surfaces on blades 32 and retainers 34 as will be described below.

A pair of circumferentially spaced elongate keyways or grooves 46, rectangular in cross-section, extend from end to end on support blade 30. Keyways 46 are used to position respective retainers 34 relative to support block 30. Also, two laterally spaced rows of threaded apertures 48 are longitudinally disposed along support block 30.

Figure 3:
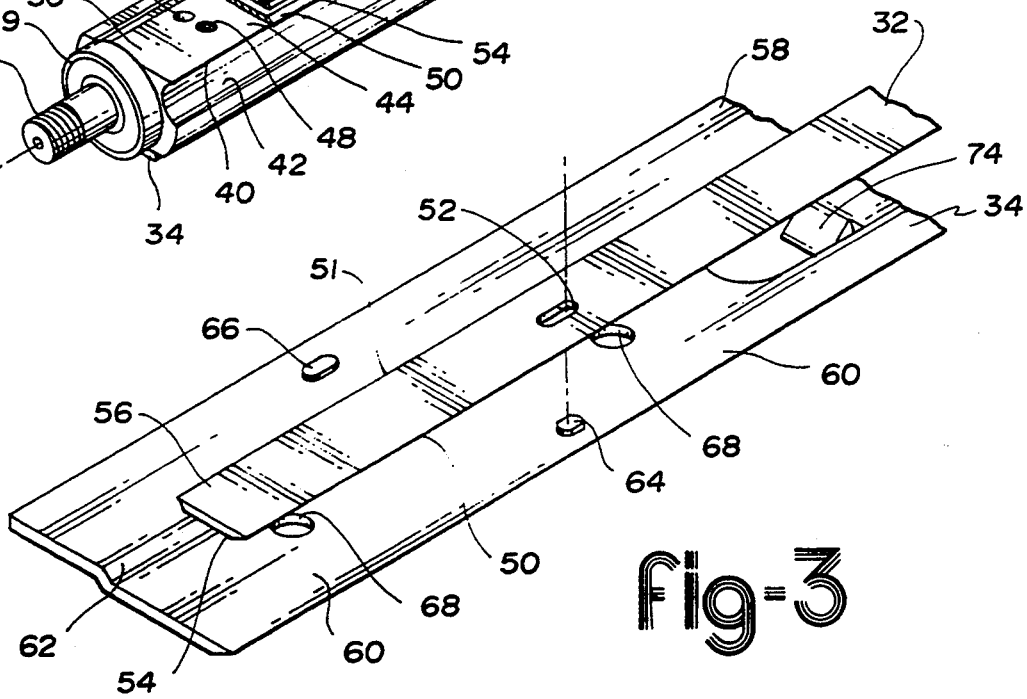
FIG. 3 is an exploded fragmentary perspective view of end portions of a blade and a retainer.

FIG. 3 shows fragmentary end portions of a blade 32 and a retainer 34. The other end portions of blades 32 and retainers 34 are generally similar and are not shown. Blade 32 has a pair of laterally spaced cutting edges 50 and 51 which extend parallel to longitudinal axis 36 of support block 30 when blade 32 is mounted to support block 30. Centrally located between cutting edges 50 and 51 are a pair of elongate slots 52, only one of which is shown in FIG. 3. The other slot 52 is located in the other end of blade 32. Blade 32 also has a retainer interfacing surface 54 and a support block interfacing surface 56. Blades 32 are trapezoidal in cross-section with support block interfacing surface 56 being wider than and parallel to retainer interfacing surface 54. Cutting edges 50 and 51 define the other sides of the trapezoid.

Each retainer 34 includes a support block mounting surface 58 and blade clamping surface 60 which are joined by an elongate bend portion 62. Support block mounting surface 58 and blade clamping surface 60 extend generally parallel to one another and are offset in height by approximately the thickness of a blade 32. Accordingly, when a blade 32 is clampingly held between retainer 34 and support block 30, as shown in FIG. 2, support block mounting surface 58 is flush with support block 30 and blade clamping surface 60 is flush with retainer interfacing surface 54 of blade 32. Only small segments of blades 32 containing cutting edges 50 or 51 are allowed to overhang undercuts 42. Tabs 74 protrude from and may be used to grasp retainers 34.

Each retainer has a pair of longitudinally spaced alignment ribs 64 formed therein, one of which is shown in FIG. 3. The width of alignment ribs 64 are tightly toleranced with the width of elongate slots 52 so that cutting edges 50 and 51 of blades 32 are precisely radially located relative to longitudinal axis 36 of support block 30. Accordingly, each of the diametrically opposed cutting edges 50 or 51 which are exposed to and plane workpiece 22 as cutting head assembly 12 rotates, are identically radially spaced from longitudinal axis 36. Similarly, either cutting edges 50 or 51, which are retained between retainers 34 and support block 30, are precisely laterally located. However, as slots 52 are longer than alignment ribs 64, blades 32 are longitudinally adjustable relative to support block 30.

Retainers 34 also have positioning tabs 66 in each of their ends which are received in keyways 46 of support block 30. Accordingly, retainers 34 are precisely located relative to longitudinal axis 36 and support block 30. Retainers 34 have a plurality of longitudinally spaced apertures 68. Screws 70 are inserted through apertures 68 and are received in threaded apertures 48 of support block 30 to clampingly retain retainers 34 to support block 30. During this clamping retainment, support block mounting surface 58 of retainer 34 mates with planar portion 44 of support block 30 and blade clamping surface 60 of retainer 34 captures blade 32 against planar portion 44.

The assembly of blades 32 and retainers 34 to support block 30 is easily performed. First, a blade 32 is laid upon a planar portion 44 of support block 30. Next, retainer 34 is placed over blade 32 with alignment ribs 64 being received in elongate slots 52 of blade 32. Further, positioning tabs 66 are received within keyway 46 of support block 30. Screws 70 are then inserted through apertures 68 in retainer 34 and into threaded apertures 48 of support block 30 to clampingly retain blade 32 between retainer 34 and support block 30. This procedure is again repeated to secure the other blade 32 between support block 30 and the other retainer 34. The cutting edges 50 and 51 extending from retainers 34 will perform the cutting or planing operation.

Cutting head assembly 12 is then mounted within carrier 16. A workpiece or board 22 is placed upon platen 18 and crank 20 is turned to lower carrier 16 and cutting head assembly 12 adjacent to workpiece 22. Carrier 16 is lowered just sufficiently such that thin layers of material are shaved from workpiece 22 as workpiece 22 passes over platen 18 and under cutting head assembly 12. Carrier 16 is then lowered slightly again and another layer of material is removed as workpiece 22 moves relative to cutting head assembly 12. This process is repeated until the work surface on workpiece 22 is planar.

As cutting edges 50 or 51 rotate about longitudinal axis 36, the straight cutting edges 50 or 51 sweep out a cylindrical surface. In the event workpiece 22 contains an unusually hard anomaly, such as a nail or a knot, nicks can be formed in the cutting edges 50 or 51. As the cutting edges 50 or 51 spin at a high rates of speed, longitudinally aligned nicks are formed in each of the blades 32 corresponding to the location of the anomaly. Accordingly, thereafter when workpiece 22 is being planed, an upwardly extending ridge will be formed on workpiece 22 which corresponds to the longitudinally aligned nicks in cutting edges 50 or 51 of blades 32.

To overcome this problem, cutting head assembly 12 is removed from carrier 16 and one of the blades 32 is moved slightly longitudinally such that the nicks in the cutting edges 50 or 51 are offset from one another. To do this, screws 72 are loosened to relieve the clamping pressure applied by retainer 34 upon a blade 32. The blade 32 is then slid longitudinally with alignment ribs 64 sliding within elongate slots 52 of its respective retainer 34. Screws 72 are then tightened down to again clampingly retain blade 32. Cutting head assembly 12 is then reinstalled into carrier 16 and the planing operation is resumed. As the nicks on the cutting edges 50 or 51 are now no longer longitudinally aligned with one another, the cutting edges will again sweep out a perfectly cylindrical surface. While one of blades 32 with a nick therein may not cut the work surface of workpiece 22 into a perfect planar surface, i.e., a ridge would be left, the other cutting edge 50 or 51 on the other blades 32 will remove this ridge as its nick is no longer longitudinally aligned with the nick on the first blade 32.

When blades 32 become sufficiently nicked or worn to the point where either blades 32 are dull or else it is not possible to offset all of the nicks in the cutting edges 50 or 51, the blades 32 may be reversed and remounted with previously unused cutting edges 50 or 51 formerly held beneath retainers 34 now serving to plane workpieces 22. As the elongated slots 52 are centrally located between each of the cutting edges 50 or 51, the radial distance between longitudinal axis 36 and each of the cutting edges 50 or 51 doing the planing is again precisely located at a predetermined distance. When both of the cutting edges 50 or 51 on a blade become worn or excessively nicked, blades 32 can be discarded and new blades 32 may be installed into cutting head assembly 12.

While the foregoing specification of this invention has been described in relation to a certain preferred embodiment thereof, and many details have been set forth for purposes of illustration, it will be apparent to those skilled in the art that the invention is susceptible to additional embodiments and that certain of the details described herein can be varied considerably without departing from the basic principals of the invention.

What is claimed:

1. A rotatable cutting head assembly for a wood cutting machine which planes a work surface on a workpiece, the cutting head assembly comprising:

a rotatable elongate support block extending along a longitudinal axis;

a pair of blades, circumferentially spaced about and removably attached to the support block, each blade having a straight elongate cutting edge which extends parallel to and support block interfacing surfaces being juxtaposed the respective retainers and the support block with the alignment ribs being slidably received within the elongate slots to maintain at least two of the cutting edges at equidistant radial distances from the longitudinal axis of the support block while permitting the blades to be longitudinally adjustable relative to the support block to enable a user to offset any longitudinally aligned nicks formed on the cutting edges during planing so that the cutting edges create a smooth planar surface free of ridges.

2. The cutting head assembly of claim 1 wherein:

the elongate slots are formed in the blades and the alignment ribs are formed in the retainers.

3. The cutting head assembly of claim 2 wherein:

each blade has a pair of longitudinally spaced elongated slots and each retainer has a pair of corresponding longitudinally spaced alignment ribs.

4. The cutting head assembly of claim 1 wherein:

each blade has first and second laterally spaced and longitudinally extending cutting edges, one of the first or second cutting edges extending laterally and being exposed from its respective retainer to plane a workpiece while the other of the first or second cutting edges is held between the retainer and the support block, the cutting edges which are exposed being equidistantly spaced from the longitudinal axis.

5. The cutting head assembly of claim 4 wherein:

the elongate slots in the blades are centrally located between the first and second cutting edges so that the blades may be reversibly mounted to the support block with either of their first or second cutting edges extending laterally and being exposed from their retainers.

6. The cutting head assembly of claim 1 wherein:

the retainers have holes extending therethrough and the support block has threaded apertures therein with threaded fasteners extending through the apertures and being threadedly received in the threaded holes to secure the retainers to the support block.

7. The cutting head assembly of claim 1 wherein:

each retainer has a positioning tab and the support block has a pair of positioning recesses which receive the respective positioning tabs to position the retainers relative to the support block.

8. An apparatus for planing a work surface on a workpieces, the apparatus comprising:

a frame;

a platen secured relative to the frame;

a carrier secured relative to the frame;

moving means for moving the carrier relative to the platen;

a motor; and a rotatable cutting head assembly rotatably supported within the carrier and rotatably driven by the motor, the cutting head assembly including:

a rotatable elongate support block extending along a longitudinal axis;

a pair of blades, circumferentially spaced about and removably attached to the support block, each blade having a straight elongate cutting edge which extends parallel to and is spaced radially from the longitudinal axis of the support block; and a pair of elongate retainers, each retainer being attachable to the support block to clamp a respective blade therebetween;

the retainers, the blades and the support block having cooperating alignment ribs and elongate slots, the slots extending parallel to the longitudinal axis of the support block, which maintain at least two of the cutting edges at equidistant radial distances from the longitudinal axis while permitting the blades to be longitudinally adjustable relative to the support block to enable a user to offset any longitudinally aligned nicks formed on the cutting edges during planing so that the cutting edges create a smooth planar surface free of ridges.

9. The apparatus of claim 8 wherein:

the elongate slots are formed in the blades and the alignment ribs are formed in the retainers.

10. The apparatus of claim 9 wherein:

each blade has a pair of longitudinally spaced elongated slots and each retainer has a pair of corresponding longitudinally spaced alignment ribs.

11. The apparatus of claim 8 wherein:

each blade has first and second laterally spaced and longitudinally extending cutting edges, one of the first or second cutting edges extending laterally and being exposed from its respective retainer to plane a workpiece while the other of the first or second cutting edges is held between the retainer and the support block, the cutting edges which are exposed being equidistantly spaced from the longitudinal axis.

12. The apparatus of claim 11 wherein:

the elongate slots in the blades are centrally located between the first and second cutting edges so that the blades may be reversibly mounted to the support block with either of their first or second cutting edges extending laterally and being exposed from their retainers.

13. The apparatus of claim 8 wherein:

the retainers have holes extending therethrough and the support block has threaded apertures therein with threaded fasteners extending through the apertures and being threadedly received in the threaded holes to secure the retainers to the support block.

14. The apparatus of claim 1 wherein:

each retainer has a positioning tab and the support block has a pair of positioning recesses which receive the respective positioning tabs to position the retainers relative to the support block.

15. A disposable blade for use in a rotatable cutting head assembly, the cutting head assembly having a rotatable elongate support block extending along a longitudinal axis and a pair of retainers which are secured to the support block, each retainer having a generally square alignment rib for aligning the blade relative to the support block, the blade comprising:

an elongate body having a pair of laterally spaced cutting edges, which extend longitudinally and which are parallel to one another, a retainer interfacing surface and a block interfacing surface, and an elongate slot which extends longitudinally and is centrally located between the cutting edges, the slot extending through the body from the retainer interfacing surface to the support block interfacing surface;

wherein a pair of such blades may be mounted to the support block with the retainer interfacing surfaces and the support block interfacing surfaces being juxtaposed the respective retainers and the support block with the alignment ribs being slidably received within the elongate slots to maintain at least two of the cutting edges at equidistant radial distances from the longitudinal axis of the support block while permitting the blades to be longitudinally adjustable relative to the support block to enable a user to offset any longitudinally aligned nicks formed on the cutting edges during planing so that the cutting edges create a smooth planar surface free of ridges.

16. The blade of claim 15 wherein: the blade has a pair of longitudinally elongated slots.

* * * * *

UNITED STATES PATENT AND TRADEMARK OFFICE

CERTIFICATE OF CORRECTION

PATENT NO. : 5,398,739
DATED : March 21, 1995
INVENTOR(S) : Everts, et. al.

It is certified that error appears in the above-indentified patent and that said Letters Patent is hereby corrected as shown below:

Column 5, Line 35

Delete Claim 1 and insert --

1. A rotatable cutting head assembly for a wood cutting machine which planes a work surface on a workpiece, the cutting head assembly comprising:

a rotatable elongate support block extending along a longitudinal axis;

a pair of blades, circumferentially spaced about and removably attached to the support block, each blade having a straight elongate cutting edge which extends parallel to and is spaced radially from the longitudinal axis of the support block; and a pair of elongate retainers, each retainer being attachable to the support block to clamp a respective blade therebetween;

the retainers, the blades and the support block having cooperating alignment ribs and elongate slots, the slots extending

UNITED STATES PATENT AND TRADEMARK OFFICE

CERTIFICATE OF CORRECTION

PATENT NO. : 5,398,739

DATED : March 21, 1995

INVENTOR(S) : EVERTS et al.

It is certified that error appears in the above-indentified patent and that said Letters Patent is hereby corrected as shown below:

parallel to the longitudinal axis of the support block, which maintain at least two of the cutting edges at equal radial distances from the longitudinal axis while permitting the blades to be longitudinally adjustable relative to the support block to enable a user to offset any longitudinally aligned nicks formed on the cutting edges during planing so that the cutting edges create a smooth planar surface free of ridges on the workpiece.

Column 7, Line 25
(Amendment dated November 1, 1994):

Delete Claim 15 and insert --

15. A disposable blade for a rotatable cutting head assembly, the cutting head assembly having a rotatable elongate support block extending along a longitudinal axis and a pair of retainers which are secured to the support block, each retainer having a generally square alignment rib for aligning the blade relative to the support block, the blade comprising:

an elongate body having a pair of laterally spaced cutting edges, which extend longitudinally and which are parallel to one another, a retainer interfacing surface and a block interfacing surface, and an elongate

UNITED STATES PATENT AND TRADEMARK OFFICE

CERTIFICATE OF CORRECTION

PATENT NO. : 5,398,739

DATED : March 21, 1995

INVENTOR(S) : Everts, et. al.

It is certified that error appears in the above-indentified patent and that said Letters Patent is hereby corrected as shown below:

Slot which extends longitudinally and is centrally located between the cutting edges, the slot extending through the body from the retainer interfacing surface to the support block interfacing surface; the blade being trapezoidal in cross-section, the cutting edges, the retainer interfacing surface and the support block interfacing surface defining outer boundary of the cross-section, with the support block interfacing surface being wider than the retainer interfacing surface;

UNITED STATES PATENT AND TRADEMARK OFFICE

CERTIFICATE OF CORRECTION

PATENT NO. : 5,398,739

DATED : March 21, 1995

INVENTOR(S) : Everts, et. al.

It is certified that error appears in the above-indentified patent and that said Letters Patent is hereby corrected as shown below:

wherein a pair of such blades may be mounted to the support block with the retainer interfacing surfaces and the support block interfacing surfaces being juxtaposed the respective retainers and the support block with the alignment ribs being slidably received within the elongate slots to maintain at least two of the cutting edges at equidistant radial distances from the longitudinal axis of the support block while permitting the blades to be longitudinally adjustable relative to the support block to enable a user to offset any longitudinally aligned nicks formed on the cutting edges during planing so that the cutting edges create a smooth planar surface free of ridges.

Signed and Sealed this

Eleventh Day of July, 1995

*Attest:*

Bruce Lehman

BRUCE LEHMAN

*Attesting Officer*

*Commissioner of Patents and Trademarks*